US011581009B2

(12) United States Patent
Boudreau et al.

(10) Patent No.: US 11,581,009 B2
(45) Date of Patent: Feb. 14, 2023

(54) SYSTEM AND A METHOD FOR SOUND RECOGNITION

(71) Applicant: SYSTÈMES DE CONTRÔLE ACTIF SOFT DB INC., Québec (CA)

(72) Inventors: Alex Boudreau, Sherbrooke (CA); Michel Pearson, Québec (CA); Louis-Alexis Boudreault, Québec (CA); Shean De Montigny-Desautel, Québec (CA)

(73) Assignee: SYSTÈMES DE CONTRÔLE ACTIF SOFT DB INC., Quebec (CA)

( * ) Notice: Subject to any disclaimer, the term of this patent is extended or adjusted under 35 U.S.C. 154(b) by 56 days.

(21) Appl. No.: 17/243,112

(22) Filed: Apr. 28, 2021

(65) Prior Publication Data

US 2021/0343309 A1 Nov. 4, 2021

Related U.S. Application Data

(60) Provisional application No. 63/018,789, filed on May 1, 2020.

(51) Int. Cl.

| | |
|---|---|
| ***G10L 25/51*** | (2013.01) |
| ***G10L 21/02*** | (2013.01) |
| ***G10L 21/14*** | (2013.01) |
| ***G10L 25/18*** | (2013.01) |

(52) U.S. Cl.

CPC ..... *G10L 25/51* (2013.01); *G10L 21/02* (2013.01); *G10L 21/14* (2013.01); *G10L 25/18* (2013.01)

(58) Field of Classification Search

None

See application file for complete search history.

(56) References Cited

U.S. PATENT DOCUMENTS

| | | | | |
|---|---|---|---|---|
| 243,696 | A | 7/1881 | Faloon | |
| 5,361,305 | A | 11/1994 | Easley et al. | |
| 5,631,566 | A | 5/1997 | Person et al. | |
| 7,117,149 | B1 * | 10/2006 | Zakarauskas | G10L 17/26 704/226 |
| 7,911,353 | B2 | 3/2011 | Bedingfield | |
| 9,060,218 | B2 | 6/2015 | Itou | |
| 9,565,504 | B2 | 2/2017 | Miyata et al. | |
| 11,386,916 | B2 * | 7/2022 | Markovic | G10L 25/18 |
| 11,404,074 | B2 * | 8/2022 | Kirsch | G10L 25/30 |
| 2021/0277564 | A1 * | 9/2021 | Mashal | D06F 34/14 |

OTHER PUBLICATIONS

Karol J. Piczak, Environmental Sound Classification With Convolutional Neural Networks, 978-1-4673-7454-5/15, © 2015 IEEE.

(Continued)

*Primary Examiner* — Paul W Huber

(74) *Attorney, Agent, or Firm* — Lavery, De Billy, LLP; Gwendoline Bruneau

(57) ABSTRACT

A method for automatic for sound recognition, comprising a) raw spectrogram generation from a sound signal spectrum; b) wide-band spectrum determination; c) wide-band continuous spectrum determination; d) tonal and time-transient spectrum determination; wide-band continuous spectrogram and tonal and time-transient spectrogram determination; and) spectrogram image generation.

20 Claims, 10 Drawing Sheets

(56) References Cited

OTHER PUBLICATIONS

Venkatesh Boddapati et al., Classifying environmental sounds using image recognition networks, 1877-0509 © 2017 The Authors. Published by Elsevier B.V.

Yuma Sakashita et al., Acoustic Scene Classification By Ensemble of Spectrograms Based on Adaptive Temporal Divisions, Detection and Classification of Acoustic Scenes and Events 2018, Challenge.

G Jawaherlalnehru et al., Music Instrument Recognition from Spectrogram Images Using Convolution Neural Network, International Journal of Innovative Technology and Exploring Engineering (IJITEE) ISSN: 2278-3075, vol. 8 Issue-9, Jul. 2019.

Lianhao Qiao et al., Sub-Spectrogram Segmentation for Environmental Sound Classification via Convolutional Recurrent Neural Network and Score Level Fusion, arXiv:1908.05863v1 [cs.SD] Aug. 16, 2019.

Quang Trung Nguyen, et al., Speech classification using SIFT features on spectrogram images, Vietnam J Comput Sci (2016) 3:247-257, DOI 10.1007/s40595-01 6-0071-3, © The Author(s) 2016. This article is published with open access at Springerlink.com.

W.B. Hussein et al., Spectrogram Enhancement by Edge Detection Approach Applied to Bioacoustics Calls Classification, Signal & Image Processing : An International Journal (SIPIJ) vol. 3, No. 2, Apr. 2012.

* cited by examiner

*Fig. 8A*
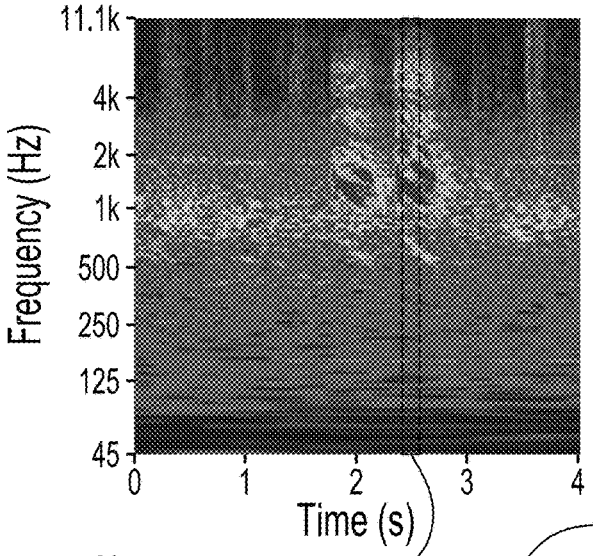
*Fig. 8B*
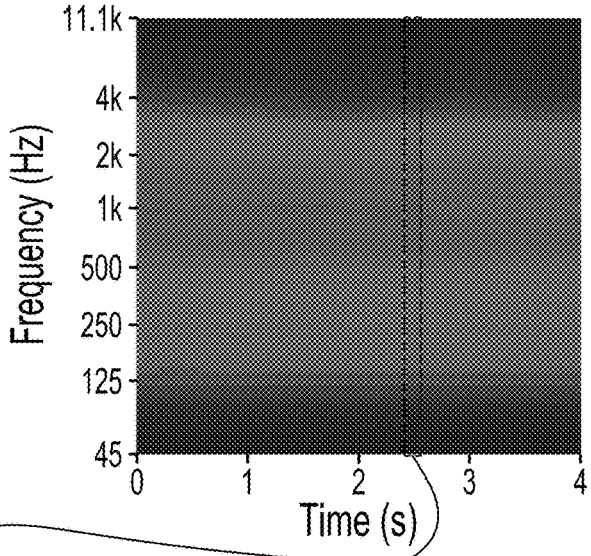
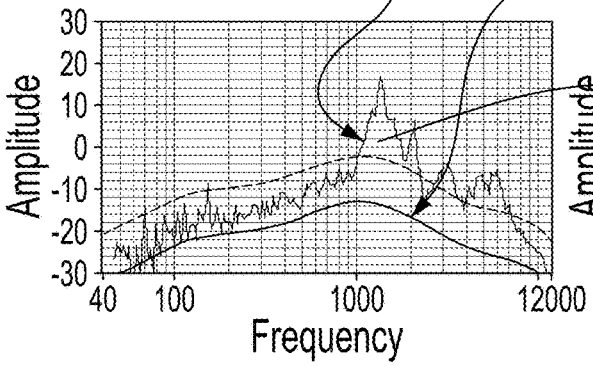
*Fig. 8C*
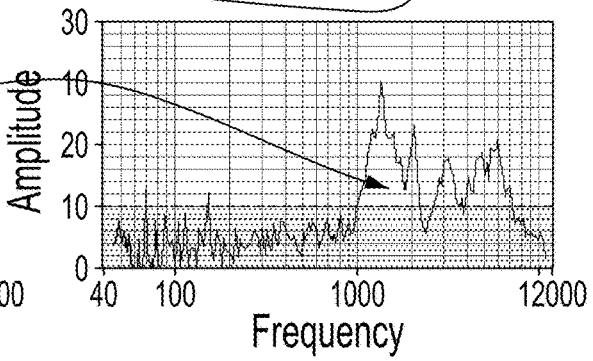
*Fig. 8D*

Wide-band Continuous

Tonal and Time-Transient

Combined

SYSTEM AND A METHOD FOR SOUND RECOGNITION

CROSS REFERENCE TO RELATED APPLICATIONS

This application claims benefit of U.S. provisional application Ser. No. 63/018,789, filed on May 1, 2020. All documents above are incorporated herein in their entirety by reference.

FIELD OF THE INVENTION

The present invention relates to sound recognition. More specifically, the present invention is concerned with a system and a method for sound recognition.

BACKGROUND OF THE INVENTION

In environmental acoustics, it is often required to measure sound levels coming from an industrial site so as to conform to noise emissions regulations. Such sound monitoring campaigns are usually performed over several days or even continuously for a 24/7 conformity assessment.

During such monitoring campaigns, a range and number of sound events not coming from the target industrial site are recorded, such as for example bird sounds, cars passing by, etc. These extraneous sound events are manually removed from the recordings to selectively assess the targeted industrial site.

Manual masking operation is time consuming. Automatic sound event classification methods have been developed, based on using spectrogram image, that is the time-frequency representation of sound signals showing the time on the horizontal axis (X), the frequency of the sound on the vertical axis (Y) and the sound level on the color intensity (Z). Typically spectrogram processing comprises successive fast Fourier transform operations performed on short intervals short time intervals ranging between about 10 ms and about 50 ms (STFT for short-time Fourier transform). For instance, short time Fourier transform (STFT) using a time frame of 50 ms provides a spectral analysis with a 20 Hz frequency resolution, and the spectrum energy between 20 Hz and 20 kHz is divided in the frequency bins [20, 40, 60, 80, . . . 19920, 19940, 19960, 19980, 20000].

However, the human hear perceives sound frequencies in a logarithmic fashion, as opposed to in a linear fashion, thereby perceives a same tonal change between 200 Hz and 400 Hz and between 2000 Hz and 4000 Hz for example. The human hear perceives low frequency sounds, such as the sound of a truck pass-by for example, and high-frequency sounds, such as the sound of bird chirping for example, with the same tonal sensitivity even though the low-frequency range, in the range between about 20 and about 200 Hz, is much smaller on a linear scale than the high-frequency range, in the range between about 2000 and about 20000 Hz. On a logarithmic scale, these frequency ranges have a same bandwidth. Moreover the short time Fourier transform (STFT) is characterized by an unbalanced spectral energy density between low frequencies and high frequencies. For a broadband signal, the energy at low frequency is higher than the energy at high frequency energy because the energy content is spread over a smaller number of frequencies when expressed linearly. In addition, the short time Fourier transform (STFT) is characterized by an inherent time-frequency duality, which may be an issue when applied to wide band spectrogram processing. For instance a 20 Hz frequency resolution obtained using a 50 ms short time Fourier transform (STFT) is not fine enough to correctly identify low-frequency sounds, for which a finer resolution of about 1 Hz is needed. Such finer resolution may be obtained with an increase of the short time Fourier transform (STFT) interval to long time interval of about 1 s for example, which would average short transient sound events such as the bird chirps.

Thus, short-time Fourier transform (STFT) implies several fundamental limitations that have an effect on the quality of the resulting spectrogram images. In addition, the background noise, which may be high in the environment, has an important effect on the contrast of the sound events shown on the spectrogram images, may need to be removed from the spectrogram images to enhance the contrast of the sound events.

There is still a need in the art for a system and a method for sound recognition.

SUMMARY OF THE INVENTION

More specifically, in accordance with the present invention, there is provided a method for automatic for sound recognition, comprising a) raw spectrogram generation from a sound signal spectrum; b) wide-band spectrum determination; c) wide-band continuous spectrum determination; d) tonal and time-transient spectrum determination; wide-band continuous spectrogram and tonal and time-transient spectrogram determination; and) spectrogram image generation.

There is further provided a method for automatic for sound recognition, comprising a) raw spectrogram generation from a sound signal spectrum; b) wide-band spectrum determination; c) wide-band continuous spectrum determination; d) tonal and time-transient spectrum determination; e) wide-band continuous spectrogram and tonal and time-transient spectrogram determination; and f) spectrogram image generation; wherein step a) comprises using a fractional octave filter bank using a frequency-adapted band filter time response, yielding a filtered time-signal per frequency band; step b) comprises using a wide-band spectral envelope; step c) comprises applying an exponential percentile estimator on the wide-band spectrum; step d) comprises subtracting the wide-band continuous spectrum from the raw sound signal spectrum; step e) comprises accumulating the wide-band continuous spectrum into the wide-band continuous spectrogram and accumulating the tonal and time-transient spectrum into the tonal and time-transient spectrogram; and step f) comprises combining the wide-band continuous spectrogram and the tonal and time-transient spectrogram into spectrogram image frames.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIG. 8A shows a raw signal spectrogram;

FIG. 8B shows the wide-band continuous spectrogram from the raw signal of FIG. 8A;

FIG. 8C shows the spectrogram at a specific time from the raw spectrogram of FIG. 8A, the spectrum at the same specific time from the wide-band continuous spectrogram of FIG. 8B, and a threshold spectrum determined by offset of the wide-band continuous spectrum of FIG. 8B;

FIG. 8D shows normalized spectra with respect to the wide-band continuous spectrum of FIG. 8B;

DESCRIPTION OF ILLUSTRATIVE EMBODIMENTS

The present invention is illustrated in further details by the following non-limiting examples.

Figure 1:
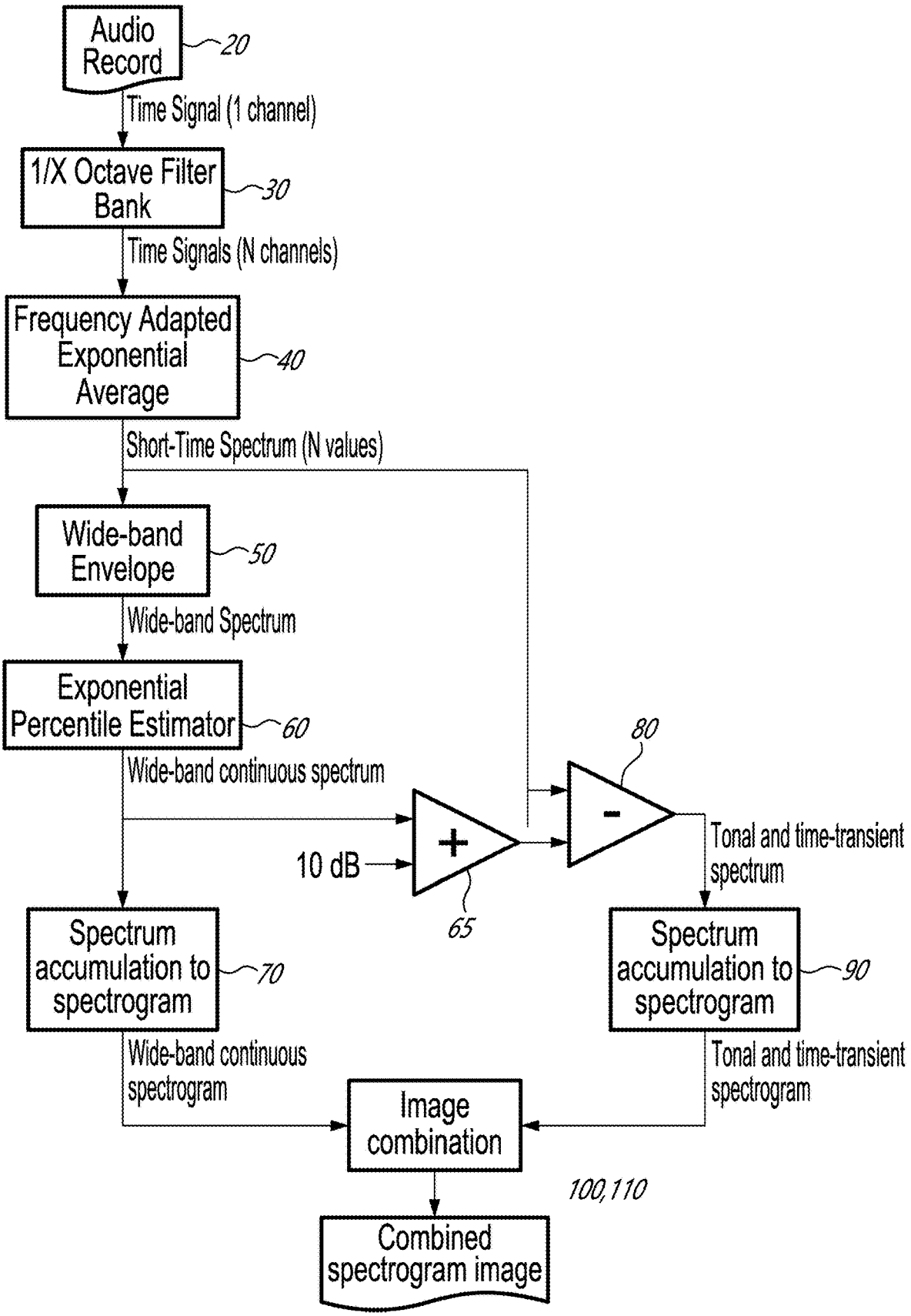
FIG. 1 is a diagrammatic view of a method according to an embodiment of an aspect of the present disclosure.

A method according to an embodiment of an aspect of the present disclosure as illustrated for example in FIG. 1 comprises recording a sound signal spectrum of an audio signal (step 20), and, in a time frame of interest for spectrogram image frame generation, spectral processing the time signals (step 30), energetic evaluation of the band-filtered time signals using a frequency adapted exponential average (step 40). Then, the method comprises, determining the wide-band continuous spectrum using a wide-band spectral envelope and exponential percentile estimator (steps 50, 60) to obtain a wide-band continuous spectrogram (step 70) and identifying tonal and time emergences, that is determining the tonal and time transient spectrum from the short-time spectrum (step 80) to obtain a tonal and time-transient spectrogram (step 90), for generation of spectrogram image frames (step 100) and combining the wide-band continuous and tonal and time-transient spectrograms into spectrogram images (step 110).

Audio signals recorded by field sound recorders may be transmitted to a web server for processing as described hereinabove, generating images to an artificial intelligence which returns the identification of the sound event. Alternatively, a self-contained system, such as a sound level meter equipped with an on-board processing unit performing the above steps, may be used.

The time signals of the audio records are spectrally processed using a fractional octave filter bank, using a band filter time response adapted to the frequency, namely faster at high frequency and slower at low frequency. The signal is thus decomposed into N octave fractional-octave subbands, an octave-band being a frequency band where the highest frequency is twice the lowest frequency (step 30).

Figure 2:
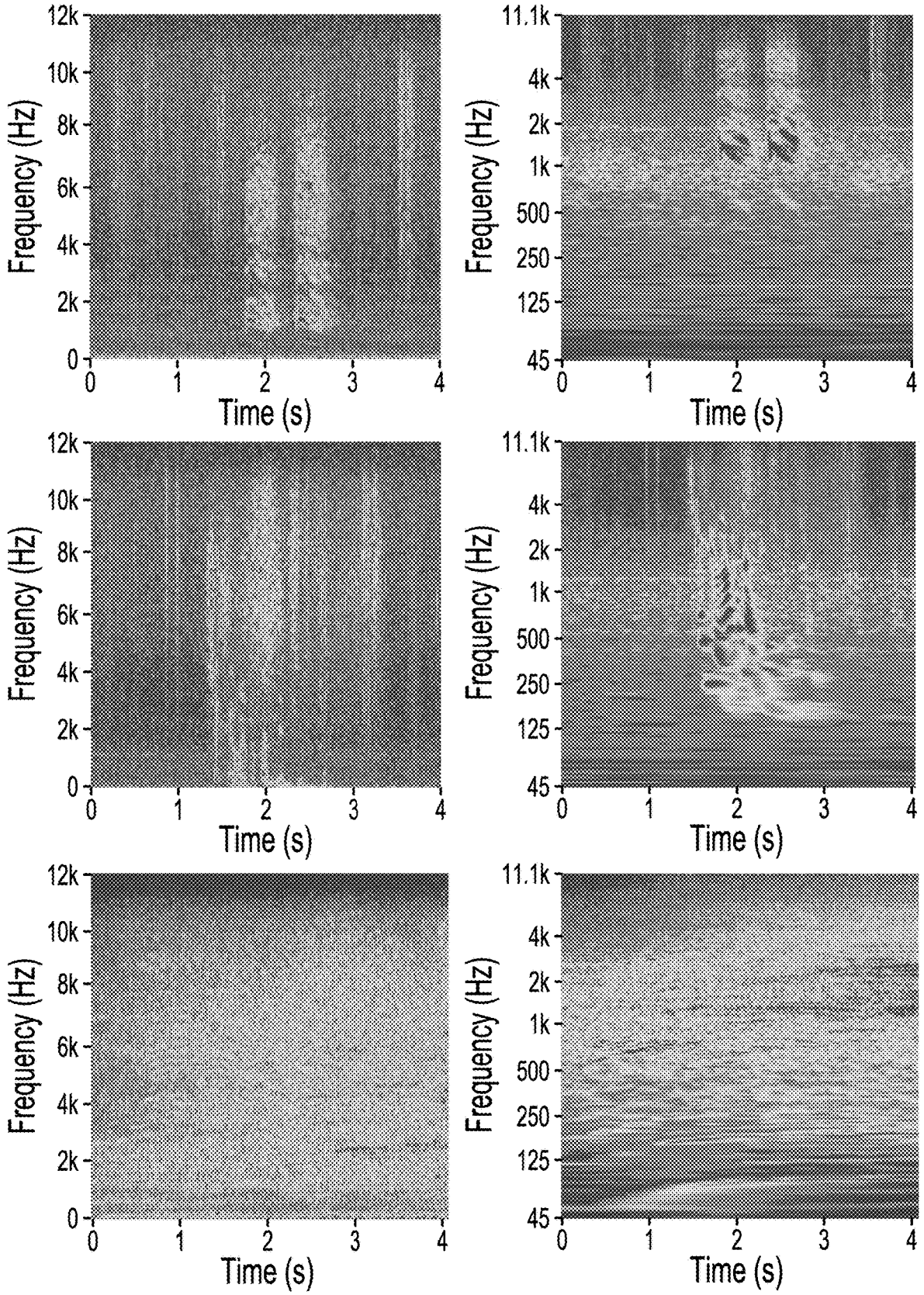
FIG. 2 shows spectrogram images using short time Fourier transform (STFT) (left column) and fractional octave band filter bank (right column) for a crow call (top row), human speech (middle row), and a truck pass-by (bottom row)

The obtained logarithmic repartition of the spectrum frequencies results in a fine frequency resolution at low frequency and a broader resolution at high frequency, and a logarithmic bandwidth with respect to frequency, which balances the energy content between the low and high frequency ranges. FIG. 2 show a comparison between short time Fourier transform (STFT) spectrogram images (left column) and fractional octave band filters spectrogram images (right column) for a crow call (top row), human speech (middle row), and a truck pass-by (bottom row). The fractional octave band filter bank spectrogram images (left column) show a more balanced frequency range, as best seen in the case of human speech (middle row), or in the case of the truck pass-by (bottom row), where the engine harmonics at 90 Hz, 180 Hz and 270 Hz for example are not visible on the short time Fourier transform (STFT) spectrogram (left column).

The original audio signal is thus split into N filtered time signals, N being the number of frequency bands. The energetic content of the band-filtered time signals is determined using an exponential average (step 40), as follows:

$$y[n] = \begin{cases} x[n], & n = 0 \\ (1-\alpha)\cdot x[n] + \alpha \cdot y[n-1], & n \geq 1 \end{cases}$$

with y[n] an average result at sample n; x[n] the value of input sample n; and a an average weight determined as follows:

$$\alpha = e^{(-1/Fs \cdot \tau)}$$

with Fs the sampling frequency in Hertz, and τ a time constant in seconds. A frequency-adapted time constant τ is selected to adjust for each frequency band signal, as follows:

$$\tau = \frac{1}{(Fh - Fl)\cdot \log(Fc)}$$

with $F_h$ an octave fraction filter upper cutoff frequency in Hertz, $F_l$ an octave fraction filter lower cutoff frequency in Hertz, and $F_c$ an octave fraction filter center frequency in Hertz.

The time constant $\tau$ is thus longer at low frequency and shorter at high frequency. For instance for a 1/24 octave band filter centered on 50 Hz the time constant is 0.4 s, whereas for a 1/24 octave band filter centered on 5000 Hz the time constant is 0.0018 s.

Then, the characteristics of the recorded sound event are determined, based on frequency tones, that is frequency peaks in the spectrum, and temporal transitions, that is peaks or sharp transitions in time. A whistle or a bird call are examples of sound events with strong tonal features, while a door slam or a gunshot are examples of sound events with strong temporal transients. The method comprises monitoring the tonal emergences and the temporal emergences of a sound with respect to the wide-band continuous background noise.

The wide-band continuous spectrum of the background noise is determined using a wide-band spectral envelope (step 50) and an exponential percentile estimator applied on the thus determined wide-band spectrum (step 60).

Figure 3A:
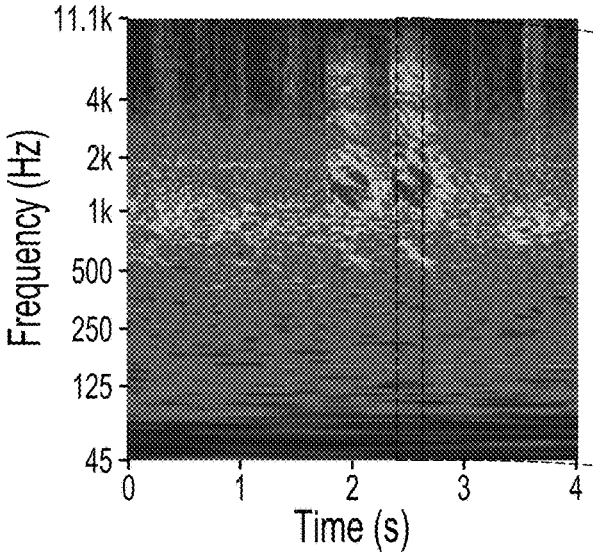
FIG. 3A shows an example of wide-band spectrum.
Figure 3B:
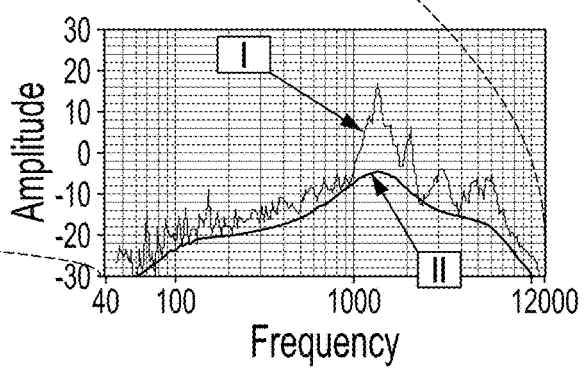
FIG. 3B is a detail of FIG. 3A.

A spectral envelope fitting the lower boundary of the spectral properties of the row spectrum of the sound event in time is selected as representation of the general shape of the spectrum tones. The spectral envelope is determined using a cubic spline by weighting frequency dips more than frequency peaks in the spectrum curve, thereby allowing identifying the wide-band component of the spectrum. FIG. 3 show an example of spectral envelope used for wide-band spectrum determination according to an embodiment of an aspect of the present disclosure. In FIG. 3B, the curve (I) shows the raw spectrum of a sound event in time and the curve (II) shows the spectral envelope, i.e. the wide-band component of the spectrum, devoid of spectral peaks as a base or floor spectrum and generally corresponding to the base line of the raw spectrum, or of the minimum frequency curve of the sound event.

The cubic spline is determined by minimizing the following relation:

$$p\sum_{i=0}^{n-1} w_i \cdot (y_i - f(x_i))^2 + (1-p) \cdot \int_{x_0}^{x_{n-1}} (f''(x))^2 dx$$

where p is a spline balance or ratio between fit and smoothness, controlling the trade-off between fidelity to the data and roughness of the function estimate; w is a weight between 0 and 1 of every value of [y]; and f is a spline relation.

Figure 4:
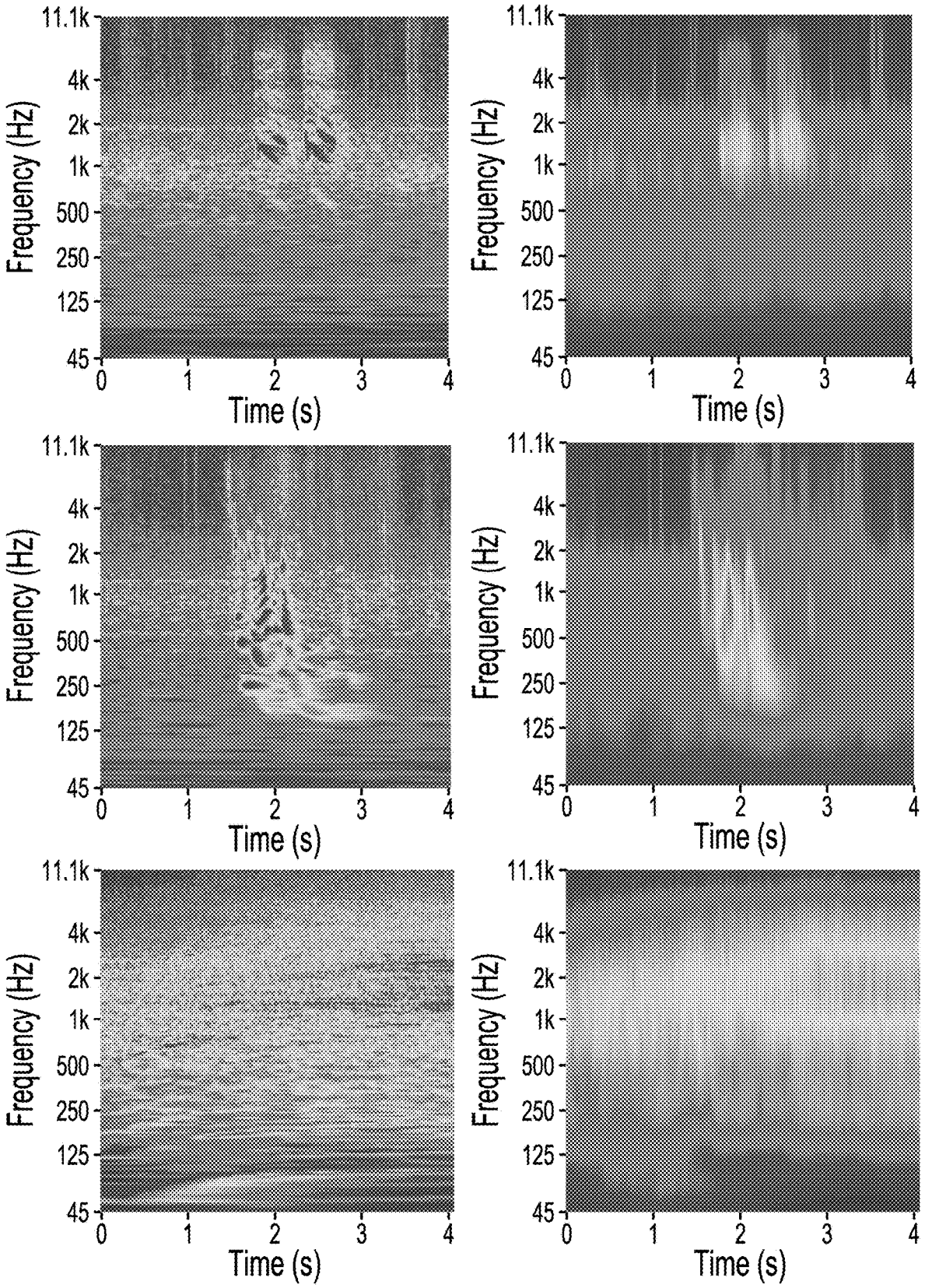
FIG. 4 shows a raw spectrogram (left column) and wide-band spectrogram (right column) for a crow call (top row), human speech (middle row), and a truck pass-by (bottom row)

The wide-band envelope spline curve is determined using a first, very smooth, spline curve representing mostly the center of the spectrum, and a second spline curve focusing on the local minima of the spectrum for representing the wide-band background noise. The first curve is defined using a unitary weight $w_1=1$ for all points and a low spline balance, for example $p_1=0.0001$; the second curve is defined using a unitary weight $w_2=1$ for all points lying below the first spline curve and a very low weight, such as $w_3=0.00001$ for example for every point lying above the first spline curve, and a higher spline balance $p_1>p_1$, for example $p_2=0.001$. The values of the spline weights and spline balances are selected depending on the nature of the sound spectrum used as input and target fitting. FIG. 4 show a raw spectrogram (left column) and the wide-band spectrogram (right column) thus obtained for a crow call (top row), human speech (middle row), and a truck pass-by (bottom row). As may be seen in the resulting wide-band spectrogram images of FIG. 4, all tonal features are removed from the raw spectrograms.

In an embodiment of an aspect of the present disclosure, the percentiles are obtained using an asymmetrical weight exponential average as a percentile estimator, expressed as follows:

$$y[n] = \begin{cases} x[n], & n = 0 \\ (1-\alpha) \cdot x[n] + \alpha \cdot y[n-1], & n \geq 1 \end{cases}$$

where y[n] is the average result at sample n; x[n] is the value of input sample n; and a is an average weight, determined as follows:

$$\alpha = e^{(-1/F_s \cdot \tau)}$$

where $F_s$ is the sampling frequency in Hertz and $\tau$ is the time constant in seconds. The value of the time constant $\tau$ is selected with respect to the current input value x[n]. A first time constant $\tau_H$ is selected if the current input value is greater than or equal to the previous average and a second time constant $\tau_L$ is selected if the current input value is lower than the previous average, as follows:

$$\tau = \begin{cases} \tau_H, & x[n] \geq y[n-1] \\ \tau_L, & x[n] < y[n-1] \end{cases}$$

Values of $\tau_H$ and $\tau_L$ are determined according to the desired percentile p between 0 and 1 and the apparent window duration T in seconds as follows:

$$\tau_H = p^2 \times T$$

$$\tau_L = (1-p)^2 \times T.$$

Figure 5:
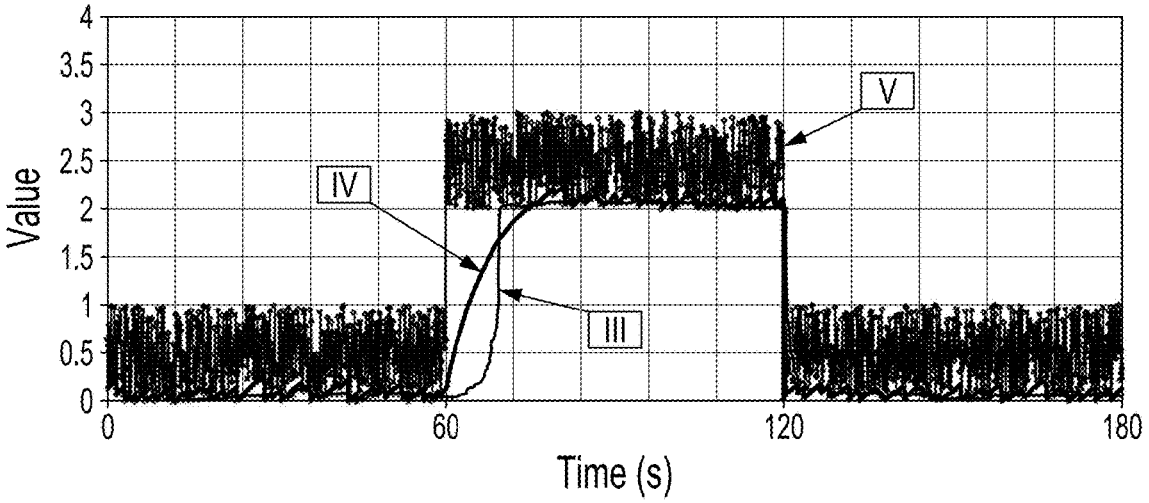
FIG. 5 shows an example of L95% percentile calculation using a 10 s histogram (curve III) and an exponential percentile estimator with apparent window duration of 10 s (curve IV), performed on arbitrary sample data (curve V)

For instance, for a desired percentile p of L95% with a 10 s apparent window duration $\tau_H=9.03$ s and $\tau_L=0.025$ s. FIG. 5 shows an example of L95% percentile calculation using a 10 s histogram (curve III) and an exponential percentile estimator with apparent window duration of 10 s (curve IV), performed on arbitrary sample data (curve V), with random numbers between 0 and 1 for the first minute, between 2 and 3 for the second minute and between 0 and 1 for the third minute.

Figure 6A:
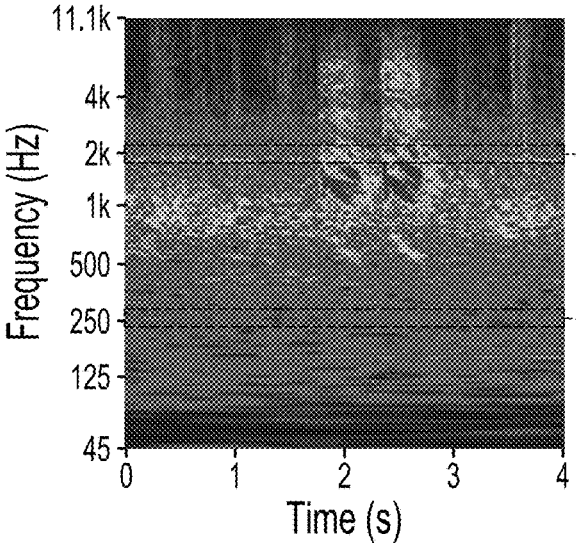
FIG. 6A shows an example of time-continuous background-noise.
Figure 6B:
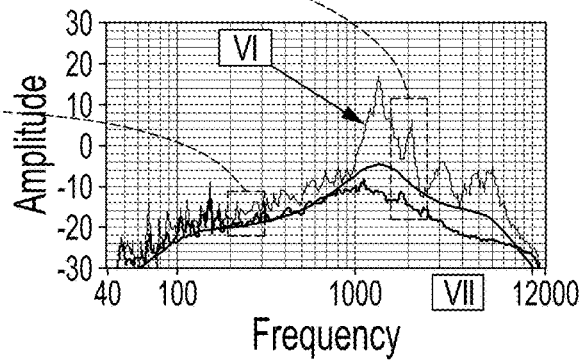
FIG. 6B is a detail of FIG. 6A.

FIG. 6 illustrate the determination of the time-continuous background noise as described hereinabove. The curve (VI) shows the average sound spectrum and the curve (VII) shows the time-continuous background spectrum. The wide band continuous background noise is determined by applying the exponential percentile estimator on the wide-band spectrum previously determined with the wide-band spectrum envelope. A spectrogram without any tone or time transition is obtained, which describes the lower amplitude boundary of the spectrogram.

The thus obtained wide-band continuous spectrum is accumulated into a wide-band continuous spectrogram (step 70).

Figure 7:
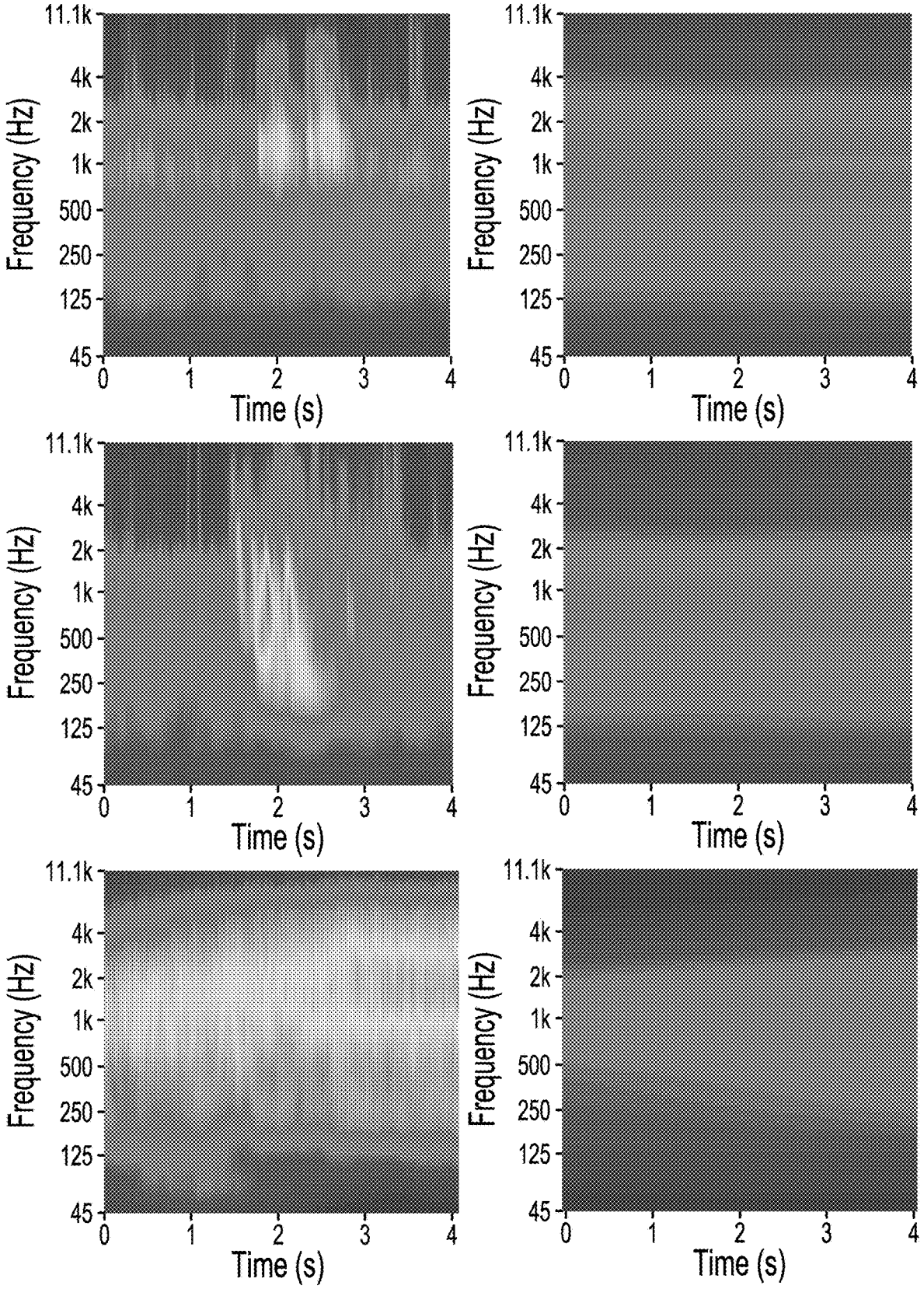
FIG. 7 shows wide-band spectrograms (left column) and wide-band continuous spectrograms (right column) for a crow call (top row), human speech (middle row), and a truck pass-by (bottom row)

FIG. 7 show raw spectrograms (left column) and wide-band continuous spectrograms (right column) for a crow call (top row), human speech (middle row), and a truck pass-by (bottom row). As may be seen in the resulting wide-band continuous spectrogram images, all time transient features are removed from the wide-band spectrograms resulting in a wide-band continuous spectrograms.

The temporal transients associated with the sound events are identified using the time continuous background noise determination using exponential percentile estimator. The identification of tonal and time transient features is performed by comparing the current spectrum to the wide-band continuous background noise spectrum (step 60). As part of the present disclosure, it was shown that a wide-band continuous signal such as a pink noise shows a small but significant tonal and time variance, especially when the observation interval is short, in the range between about 10 ms and about 50 ms. This residual tonal and time variance implies a tonal and time emergence from the wide-band continuous background noise of approximately 10 dB. In the present method, any spectrum feature that emerges more than 10 dB from the wide-band continuous background noise spectrum is considered a tonal peak or a time transient. Thus, the spectrum of tonal and time transient emergences is obtained by the subtraction of the wide-band continuous background noise spectrum from the raw spectrum shifted up by 10 dB (steps 65, 80 in FIG. 1). FIG. 8 show the determination of tonal and time transient emergences as described herein. FIG. 8A shows a raw signal spectrogram; FIG. 8B shows the wide-band continuous spectrogram from the raw signal, FIG. 8C shows a specific time of the raw spectrogram of FIG. 8A, the spectrum at the same specific time from the wide-band continuous spectrogram of FIG. 8B, and a threshold spectrum determined by the offset of the wide-band continuous spectrum; and FIG. 8D shows the normalized spectra with respect to the wide-band continuous spectrum of FIG. 8B.

The thus obtained tonal and time-transient spectrum is accumulated into a tonal and time-transient spectrogram (step 90).

The tonal and time-transient spectrogram shows the features of sound events such as a bird call, human speech, a car pass-by, a door slam, etc. In an embodiment of an aspect of the present disclosure, the tonal and time-transient spectrogram image is generated using a 10 dB dynamic on the raw spectrum from 0 dB to +10 dB for example, thereby clipping strong emergences of more than 10 dB, which allows to imprint an almost binary spectrogram enhancing the contours of the tonal and time-transient features of the spectrogram. The result is an almost white fingerprint on a black background. The specific value of the desired dynamic range may be different than the 10 dB value used herein, the value of 10 dB was determined arbitrarily to produce images with contrasting image features.

The wide-band continuous spectrogram allows identification of sound events in absence of tonal or time transient features, such as in the case of wind blowing or a distant highway for example. Although not characterized by tonal nor temporal features, such types of sound events are identified by the shape of the wide-band continuous background noise. When generating the wide-band continuous background noise spectrogram image by normalizing the wide-band continuous background noise energy to the raw spectrogram using with a dynamic of 40 dB, the wide-band continuous spectrogram image is essentially black in cases of strong tonal and time-transient emergences, because it is below the 40 dB dynamic range. In cases of low or absent tonal and time-transient emergences, the wide-band continuous spectrogram image value is higher, and appears brighter. The specific value of the desired dynamic range can be different than the 40 dB value used herein. The value of 40 dB was determined arbitrarily to allow a good balance between the discrimination of wide-band continuous spectrogram when tonal and time-transient are present and a good representation of the wide-band continuous spectrogram when tonal and time-transient are absent.

Figure 9:
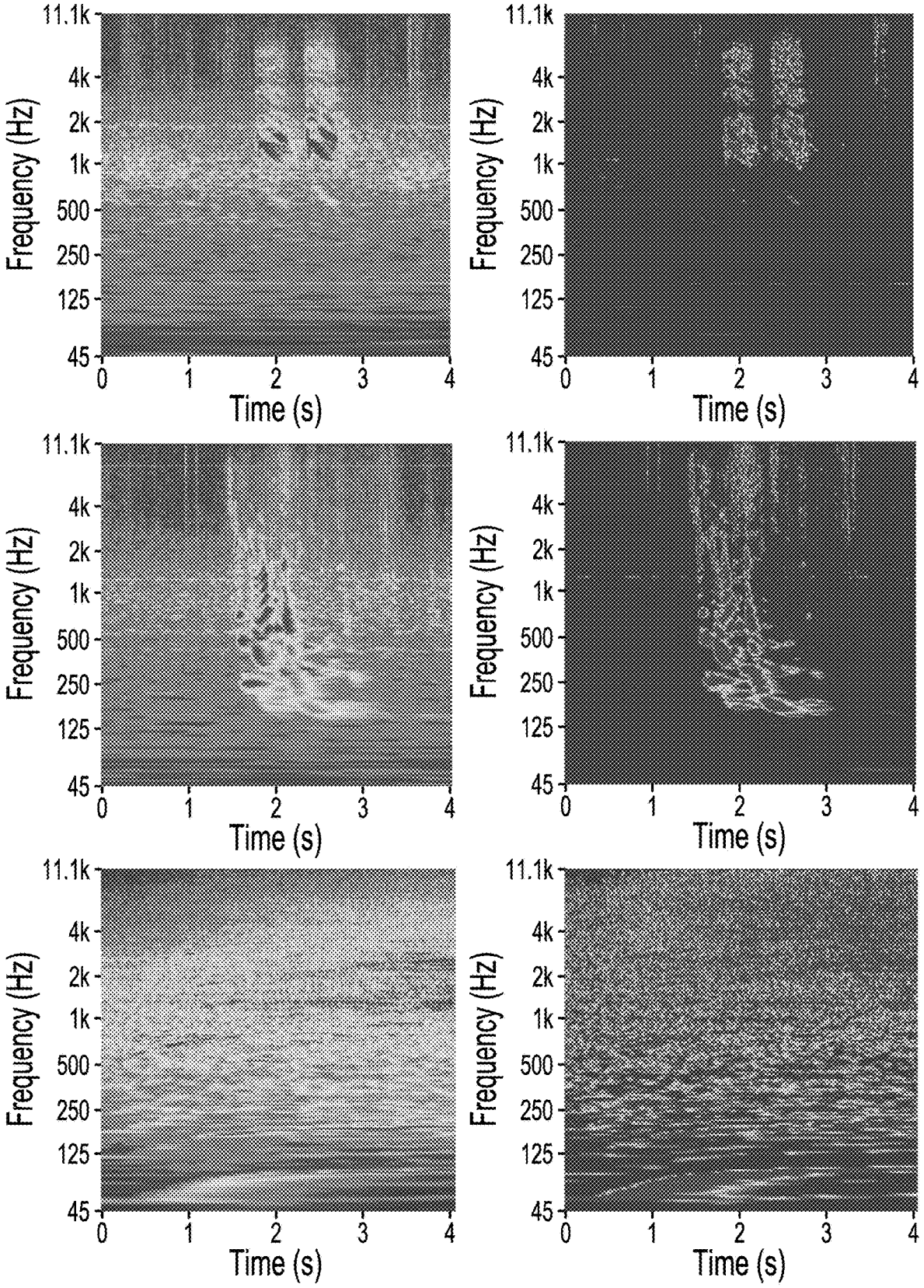
FIG. 9 shows raw spectrogram (left column) and tonal and time transient spectrograms (right column) for a crow call (top row), human speech (middle row), and a truck pass-by (bottom row)

FIG. 9 show the tonal and time-transient emergences spectrogram determined for a crow call (top row), human speech (middle row), and a truck pass-by (bottom row).

The obtained tonal and time-transient spectrogram and wide-band continuous spectrogram, instead of the raw spectrogram, are used for the spectrogram image generation (step 100)), by generating spectrogram images composed of a short interval series of spectra, with intervals in the range between about 10 ms and about 50 ms (step 110).

Figures 10A, 10B, 10C, 10D:
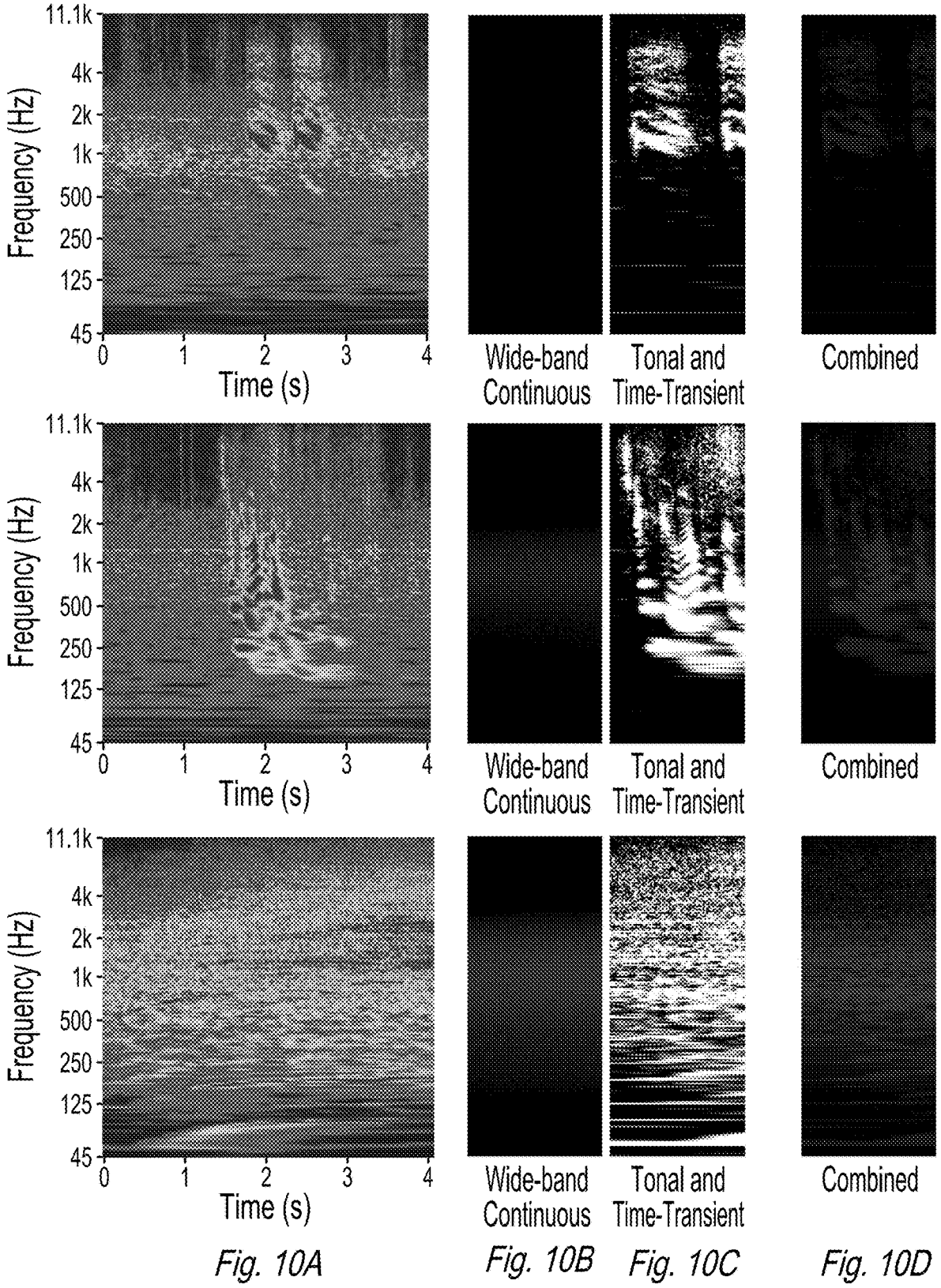
FIG. 10A shows raw signal spectrograms of a crow call (top row), human speech (middle row), and a truck pass-by (bottom row), with an indicated frame of interest for spectrogram image frame generation.
FIG. 10B shows wide-band continuous spectrograms grayscale images of the raw spectrogram in the frame indicated in FIG. 10A.
FIG. 10C shows the tonal and time transient spectrogram grayscale images in the frame indicated in FIG. 10A.
FIG. 10D shows the combined color images generated with the wide-band continuous spectrogram grayscale images of FIG. 10B and the tonal and time transient spectrogram grayscale images of FIG. 10C.
Figure 11A:
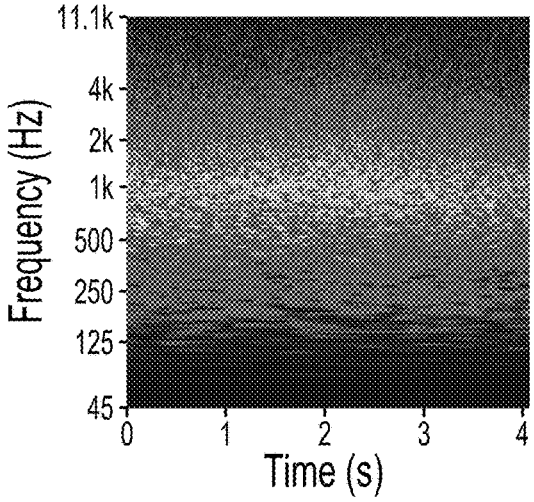
FIG. 11A shows the raw spectrogram of a wind blowing sound signal, with an indicated frame of interest for spectrogram image frame generation.
Figure 11B:
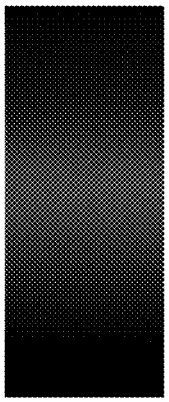
FIG. 11B shows the wide-band continuous spectrogram grayscale image of the sound signal in the frame of the sound signal of FIG. 11A.
Figure 11C:
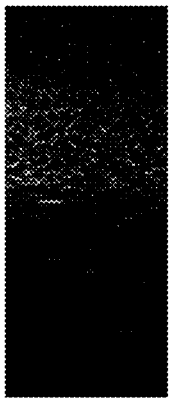
FIG. 11C shows the tonal and time transient spectrogram grayscale image of the sound signal in the frame of the sound signal of FIG. 11A.
Figure 11D:
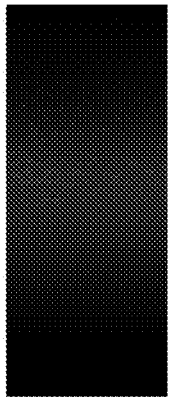
FIG. 11D shows the combined color image generated with the wide-band continuous spectrogram grayscale image of FIG. 11B and the tonal and time transient spectrogram grayscale image FIG. 11C.

In step 110, the wide-band continuous spectrogram and the tonal and time-transient spectrogram are then combined into spectrogram image frames. The images are analyzed using two channels. A first channel, for example green, is used to store the wide-band continuous spectrogram and a second channel, for example blue, to store the tonal and time-transient spectrogram. The use of these colors is arbitrary and does not have an impact on the end result. Red and green may be selected for example, with the same result, as illustrated in FIGS. 10 and 11 for example. Wide-band continuous spectrogram image frames shown in FIG. 10 show scarce distinctive information in the case of sound events mainly described by tonal and time-transient features. In contrast, images in FIG. 11, in the case of a wind blowing sound event as an example of sound events mainly described by the wide-band continuous spectrogram image frame, show details, or lack of details, in the wide-band continuous spectrogram image frame; the amount of details, or lack of details, in the wide-band continuous spectrogram image and the tonal and time-transient spectrogram image are used in combination to obtain a description of the sound event.

As people in the art will now be in a position to appreciate, the present method overcomes shortcomings inherent to short time Fourier transform (STFT) in spectral analysis by using an octave fraction filter bank. The energetic content of each band filtered signals is determined from the root mean square (RMS) average by selecting a window duration shorter than the band frequency at high frequency and longer than the band frequency at low frequency (step 40), thereby preventing discontinuities in the time series while effective from a computational point of view, in contrast to using a window duration selected on the basis of the duration of the interval at which the signal is to be sampled. In the latter case, a 50 ms window root mean square (RMS) average for instance is processed every 50 ms to get a time series, which fails to take into account the period of the signal under analysis, and may thus result in a variance problem, since a window of 50 ms on a 100 Hz signal only contains 5 signal periods in the analysis window whereas the same window duration contains 500 periods when analyzing a 10 kHz signal frequency, and as a result, the lower frequency root mean square (RMS) time history does not present the same variance than the high frequency root mean square (RMS) time history. The spectral envelope describing the general shape of the spectrum tones is selected to describe the lower boundary of the spectral properties of the original spectrum, thereby allowing identifying the wide-band component of the spectrum or spectrum floor (steps 50, 60; FIG. 3). Arithmetic average, which is not influenced by the transient events it tries to stand out from, is used to determine the time-continuous background noise (step 70). Thus, for instance, an impact noise such as a door slam, although correctly detected at a first time of occurrence is not considered in the average representing the time-continuous background noise, in such a way that a successive occurrence is also correctly detected. For instance using the L95% percentile, which is the sound level exceeded 95% of the time, allows characterizing the time-continuous background noise and subsequently the sound events emerging from the time-continuous background noise. Transient sound events have little or no effect on the L95% metric making the L95% metric a good choice for this application; the present method calculates the percentiles using an asymmetrical weight exponential average as a percentile estimator, instead of using a histogram as typically known in the art to calculate percentiles at each time interval, which may translate into calculating a 30 s histogram every 50 ms for example.

In the present method, spectrogram images composed of a short interval series of spectra, with intervals in the range between about 10 ms and about 50 ms using only the tonal and time-transient and the wide-band continuous spectrograms are used for the spectrogram image generation.

For combining the of wide-band continuous and the tonal and time-transient spectrograms images, in the present method, a first channel is used to store the wide-band continuous spectrogram and a second channel is used to store the tonal and time-transient spectrogram for analysis of the images, as opposed to methods comprising analyzing images separately on their three constituent channels, namely red, green and blue (RGB) or hue, saturation and value (HSV) and using these three channels to store different aspects of the spectrogram to analyze, for example in cases of sound events, such as wind blowing or a distant highway for example, which are not characterized by any tones or time-transients, and for which the tonal and time transient spectrogram image is almost black and the wide-band continuous spectrogram image is bright and becomes significant to determine the nature of the sound.

There is thus provided a method for automatic for sound recognition, comprising using a fractional octave band spectrum for spectrogram generation; using a wide-band spectral envelope to determine the wide-band background spectrum; using an exponential percentile estimator on the wide-band spectrum to determine the wide-band continuous background spectrum; subtracting the wide-band continuous spectrum from the raw spectrum to obtain the tonal and time-transient spectrum; and combining the wide-band continuous spectrogram image and tonal and time-transient spectrogram image to be used in an image recognition algorithm.

The use of a fractional octave-band filter bank to generate the sound spectrum results a logarithmic repartition of frequencies and overcomes inherent problems of short time Fourier transform (STFT). This logarithmic mapping allows a fine frequency resolution at low frequency and a broad resolution at high frequency. The obtained logarithmic bandwidth with respect to frequency allows balancing the spectrum energy between low and high frequencies and a time response adapted to the frequency band, namely slow at low frequency and fast at high frequency.

The use of a frequency-adapted exponential average allows overcoming variance issues associated with a fixed duration average while still offering a fast computation time.

The combined use of a wide-band spectral envelope and an exponential percentile estimator allows accurately characterizing the wide-band continuous background noise spectrum, which in turn allows accurately identifying the tonal and time-transient spectrum, which is determinant in the identification of sound events.

The combination of the wide-band continuous spectrogram image and the tonal and time-transient spectrogram image in a single image results in high value data to the image classification algorithm. The tonal and time-transient spectrogram image provides a fingerprint of the dominant features of a sound event; and the wide-band continuous spectrogram image supplies relevant information for sound events that do not contain any tonal or time-transient features. The dynamic properties of both spectrogram images allow discrimination between wide-band continuous events and tonal and time-transient events. The spectrogram image processing used to generate both spectrogram images minimizes non-relevant information contained in the raw spectrogram image that may otherwise slow down or interfere with efficiency and accuracy of the image classification algorithm.

The background noise is thus removed from the spectrogram image to enhance the contrast of the sound events and the spectrogram image value is improved by a selected combination and sequence of signal processing steps. The presently disclosed spectrogram image processing allows selective identification of complex sound events which are harder to identify.

The scope of the claims should not be limited by the embodiments set forth in the examples, but should be given the broadest interpretation consistent with the description as a whole.

The invention claimed is:

1. A method for automatic for identification of a sound event, comprising:

a) recording of a sound signal spectrum of the sound event in a time frame of interest;

b) raw spectrogram generation from the sound signal spectrum in the time frame of interest;

c) wide-band spectrum determination and wide-band continuous spectrum determination;

determining characteristics of the sound event based on frequency tones and temporal transitions by: d) tonal and time-transient spectrum determination and: e) wide-band continuous spectrogram and tonal and time-transient spectrogram determination; and f) spectrogram image generation using a tonal and time-transient spectrogram and wide-band continuous spectrogram obtained in d) and e) and combining the wide-band spectrum and the tonal and time-transient spectrum into spectrogram image frames comprising image features of the sound event; and g) identification of the sound event from the image features supplied in the spectrogram image frames generated in f) by image recognition, and returning the identification of the sound event.

2. The method of claim 1, wherein step b) comprises splitting the sound signal into filtered time signals using a fractional octave filter bank, yielding a filtered time-signal per frequency band; step c) comprises using a wide-band spectral envelope and using an exponential percentile estimator applied on the wide-band spectrum; step d) comprises subtracting the wide-band continuous spectrum from the sound signal spectrum; and step e) comprises using the tonal and time-transient spectrogram and the wide-band continuous spectrogram.

3. The method of claim 2, wherein step b) comprises using a frequency-adapted band filter time response.

4. The method of claim 2, wherein step c) comprises selecting using a cubic spline minimizing the following relation:

$$p\sum_{i=0}^{n-1} w_i \cdot (y_i - f(x_i))^2 + (1-p)\cdot w$$

with:

p=spline balance w=weight between 0 and 1 of every value of [y]

f=spline equation; and determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$.

5. The method of claim 2, wherein step b) comprises using a frequency-adapted band filter time response, and step b) comprises:

selecting using a cubic spline minimizing the following relation:

$$p\sum_{i=0}^{n-1} w_i \cdot (y_i - f(x_i))^2 + (1-p)\cdot w$$

with:

pp=spline balance w=weight between 0 and 1 of every value of [y]

f=spline equation; and determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$.

6. The method of claim 2, wherein step c) comprises selecting a frequency-adapted time constant for each frequency band signal.

7. The method of claim 2, wherein step c) comprises selecting a frequency-adapted time constant for each frequency band signal, the time constant being selected to be shorter at high frequency and longer at low frequency.

8. The method of claim 2, wherein step c) comprises selecting a frequency-adapted time constant for each frequency band signal as follows:

$$\tau = \frac{1}{(Fh - Fl)\cdot \log(Fc)}$$

with:

Fh=octave fraction filter upper cutoff frequency in Hertz

Fl=octave fraction filter upper cutoff frequency in Hertz

Fc=octave fraction filter center frequency in Hertz.

9. The method of claim 2, wherein step c) comprises using an asymmetrical weight exponential average as a percentile estimator, expressed as follows:

$$y[n] = \begin{cases} x[n], & n = 0 \\ (1-\alpha)\cdot x[n] + \alpha \cdot y[n-1], & n \geq 1 \end{cases}$$

with y[n] is an average result at sample n; x[n] is a value of input sample n; and $\propto$ is an average weight, determined as follows:

$$\propto = e^{(-1/Fs\cdot\tau)}$$

with $F_s$ is a sampling frequency in Hertz and $\tau$ is a time constant, in seconds, selected with respect to the value x[n] of input sample n as a frequency-adapted time constant for each frequency band signal.

10. The method of claim 2, wherein step c) comprises using an asymmetrical weight exponential average as a percentile estimator, expressed as follows:

$$y[n] = \begin{cases} x[n], & n = 0 \\ (1-\alpha)\cdot x[n] + \alpha \cdot y[n-1], & n \geq 1 \end{cases}$$

with y[n] is an average result at sample n; x[n] is a value of input sample n; and $\tau$ is an average weight, determined as follows:

$$\propto = e^{(-1/Fs\cdot\tau)}$$

with $F_s$ is a sampling frequency in Hertz and $\tau$ is a time constant, in seconds, selected with respect to the value x[n] of input sample n as a frequency-adapted time constant for each frequency band signal as follows:

$$\tau = \frac{1}{(Fh - Fl)\cdot \log(Fc)}$$

with:

FFh=octave fraction filter upper cutoff frequency in Hertz

Fl=octave fraction filter upper cutoff frequency in Hertz

Fc=octave fraction filter center frequency in Hertz.

11. The method of claim 2, wherein step c) comprises selecting a spectral envelope by using a cubic spline minimizing the following relation:

$$p\sum_{i=0}^{n-1} w_i \cdot (y_i - f(x_i))^2 + (1-p)\cdot w$$

with:

p=spline balance w=weight between 0 and 1 of every value of [y]

f=spline equation; and determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$; and step c) comprises using an asymmetrical weight exponential average as a percentile estimator, expressed as follows:

$$y[n] = \begin{cases} x[n], & n = 0 \\ (1-\alpha)\cdot x[n] + \alpha \cdot y[n-1], & n \geq 1 \end{cases}$$

with y[n] is an average result at sample n; x[n] is a value of input sample n; and τ is an average weight, determined as follows:

$$\alpha = e^{(-1/Fs \cdot \tau)}$$

with $F_s$ is a sampling frequency in Hertz and τ is a time constant in seconds selected with respect to the value x[n] of input sample n as a frequency-adapted time constant for each frequency band signal.

12. The method of claim 2, wherein step d) comprises shifting the wide-band continuous spectrum and subtracting the shifted subtracting the wide-band continuous spectrum from the raw spectrum.

13. The method of claim 2, wherein step c) comprises selecting a spectral envelope by using a cubic spline minimizing the following relation:

$$p\sum_{i=0}^{n-1} w_i \cdot (y_i - f(x_i))^2 + (1-p) \cdot w$$

with:

p=spline balance w=weight between 0 and 1 of every value of [y]

f=spline equation and;

determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$;

step c) comprises using an asymmetrical weight exponential average as a percentile estimator, expressed as follows:

$$y[n] = \begin{cases} x[n], & n = 0 \\ (1-\alpha) \cdot x[n] + \alpha \cdot y[n-1], & n \geq 1 \end{cases}$$

with y[n] is an average result at sample n; x[n] is a value of input sample n; and τ is an average weight, determined as follows:

$$\alpha = e^{(-1/Fs \cdot \tau)}$$

with $F_s$ is a sampling frequency in Hertz and τ is a time constant in seconds selected with respect to the value x[n] of input sample n as a frequency-adapted time constant for each frequency band signal; and step d) comprises subtracting the wide-band continuous spectrum from the raw spectrum.

14. The method of claim 2, wherein step e) comprises accumulating the wide-band continuous spectrum into the wide-band continuous spectrogram and accumulating the tonal and time-transient spectrum into the tonal and time-transient spectrogram.

15. The method of claim 2, wherein step f) comprises combining the wide-band continuous spectrogram and the tonal and time-transient spectrogram into spectrogram image frames.

16. The method of claim 2, wherein step f) comprises using a first channel to store the wide-band continuous spectrogram and a second channel to store the tonal and time-transient spectrogram.

17. The method of claim 2, wherein step f) comprises selecting a first dynamic range for generating tonal and time-transient spectrogram images, and a second dynamic range for generating wide-band continuous spectrogram images.

18. The method of claim 2, wherein step c) comprises selecting a spectral envelope by using a cubic spline minimizing the following relation:

$$p\sum_{i=0}^{n-1} w_i \cdot (y_i - f(x_i))^2 + (1-p) \cdot w$$

with:

p=spline balance w=weight between 0 and 1 of every value [y]

f=spline equation; and determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$;

step c) comprises using an asymmetrical weight exponential average as a percentile estimator, expressed as follows:

$$y[n] = \begin{cases} x[n], & n = 0 \\ (1-\alpha) \cdot x[n] + \alpha \cdot y[n-1], & n \geq 1 \end{cases}$$

with y[n] is an average result at sample n; x[n] is a value of input sample n; and τ is an average weight, determined as follows:

$$\alpha = e^{(-1/Fs \cdot \tau)}$$

with $F_s$ is a sampling frequency in Hertz and τ is a time constant in seconds selected with respect to the value x[n] of input sample n as a frequency-adapted time constant for each frequency band signal;

step d) comprises subtracting the wide-band continuous spectrum from the raw spectrum; and step e) comprises accumulating the wide-band continuous spectrum into the wide-band continuous spectrogram and accumulating the tonal and time-transient spectrum into the tonal and time-transient spectrogram.

19. The method of claim 2, wherein step c) comprises selecting a spectral envelope by using a cubic spline minimizing the following relation:

$$p\sum_{i=0}^{n-1} w_i \cdot (y_i - f(x_i))^2 + (1-p) \cdot w$$

with:

p=spline balance w=weight between 0 and 1 of every value of [y]

f=spline equation; and determining a first spline curve with a first unitary weight $w_1=1$ for all points and a first spline balance $p_1$; and a second spline curve using a second unitary weight with $w_2=1$ for all points lying below the first spline curve, a third weight $w_3<w_2$ for all points lying above the first spline curve, and a second spline balance $p_2$ higher than the first spline balance $p_1$;

step c) comprises using an asymmetrical weight exponential average as a percentile estimator, expressed as follows:

$$y[n] = \begin{cases} x[n], & n = 0 \\ (1-\alpha)\cdot x[n] + \alpha \cdot y[n-1], & n \geq 1 \end{cases}$$

with y[n] is an average result at sample n; x[n] is a value of input sample n; and τ is an average weight, determined as follows:

$$\alpha = e^{(-1/Fs \cdot \tau)}$$

with $F_s$ is a sampling frequency in Hertz and τ is a time constant in seconds selected with respect to the value x[n] of input sample n as a frequency-adapted time constant for each frequency band signal;

step d) comprises subtracting the wide-band continuous spectrum;

step e) comprises accumulating the wide-band continuous spectrum into the wide-band continuous spectrogram and accumulating the tonal and time-transient spectrum into the tonal and time-transient spectrogram; and step f) comprises combining the wide-band continuous spectrogram and the tonal and time-transient spectrogram into spectrogram image frames.

20. A method for identification of a sound event, comprising a) recording of a sound signal spectrum of the sound event in a time frame of interest; b) raw spectrogram generation from the sound signal spectrum in the time frame of interest; c) wide-band spectrum determination; and wide-band continuous spectrum determination; d) tonal and time-transient spectrum determination; e) wide-band continuous spectrogram and tonal and time-transient spectrogram determination; and f) spectrogram image generation; and g) identification of the sound event from images generated in f);

wherein step b) comprises using a fractional octave filter bank using a frequency-adapted band filter time response, yielding a filtered time-signal per frequency band; step c) comprises using a wide-band spectral envelope and applying an exponential percentile estimator on the wide-band spectrum; step d) comprises subtracting the wide-band continuous spectrum from the raw sound signal spectrum; step e) comprises accumulating the wide-band continuous spectrum into the wide-band continuous spectrogram and accumulating the tonal and time-transient spectrum into the tonal and time-transient spectrogram; said steps d) and e) determining characteristics of the sound event based on frequency tones and temporal transitions; step f) comprises combining the wide-band continuous spectrogram and the tonal and time-transient spectrogram into spectrogram image frames comprising image features of the sound event; and said step g) comprises the identification of the sound event from the spectrogram image frames generated in f) by image recognition, and returning the identification of the sound event.

* * * * *